United States Patent [19]

Vogel

[11] 4,059,264

[45] Nov. 22, 1977

[54] METHOD OF FEEDING A LEAFLET AND THE APPARATUS THEREFOR

[75] Inventor: Walter H. Vogel, Hoffman Estates, Ill.

[73] Assignee: Redington, Incorporated, Bellwood, Ill.

[21] Appl. No.: 682,248

[22] Filed: May 3, 1976

[51] Int. Cl.[2] ..... B65H 39/06

[52] U.S. Cl. ..... 271/270; 271/205; 270/58; 53/157

[58] Field of Search ..... 271/203–206, 271/277, 270; 270/58; 53/21 FW, 50, 117, 120, 157; 198/604, 606

[56] References Cited

U.S. PATENT DOCUMENTS

| | | | |
|---|---|---|---|
| 3,174,749 | 3/1965 | Childs | 271/204 |
| 3,549,145 | 12/1970 | Trautmann | 271/204 |
| 3,915,447 | 10/1975 | Perno | 271/204 |

*Primary Examiner*—Robert W. Saifer
*Attorney, Agent, or Firm*—Vogel, Dithmar, Stotland, Stratman & Levy

[57] ABSTRACT

The method and apparatus in a packaging machine for transferring leaflets to spaced clamps on a first conveyor from a second conveyor in which leaflets are deposited on the second conveyor in synchronism with clamps on the second conveyor so that a leaflet is deposited on the first conveyor, arrives at a point of convergence between the first and second conveyors just behind its respective clamp which is in an open position and then travels along the same path as the clamp at a greater speed than the clamp until the leaflet is positioned within the jaws of the clamp after which time the jaws are closed to clamp the leaflet.

6 Claims, 12 Drawing Figures

METHOD OF FEEDING A LEAFLET AND THE APPARATUS THEREFOR

BACKGROUND OF THE INVENTION

This invention relates generally to packaging machines and particularly to packaging machines in which leaflets containing advertising or instructions are inserted into a carton or package with the article.

Generally, leaflets are fed from a stack in a magazine or as a continuous strip from a roll from which they are cut into individual leaflets and conveyed to the packaging apparatus. In some machines the leaflets are inserted into the open ends of the cartons prior to the insertion of the articles into the cartons. In other machines, the leaflets are conveyed with the article buckets and are folded over the product immediately prior to its being thrust into the carton so that the article itself conveys the leaflet into the carton. The invention is primarily directed to the latter type of machine.

The present invention is an improvement over the mechanism disclosed in my co-pending application, U.S. Ser. No. 579767, Article Bucket with Circular Clamp, Filed May 22, 1975, now U.S. Pat. No. 3,982,382 granted Sept. 28, 1976. This application disclosed a conveyor which conveys article buckets. A spring-loaded leaflet clamp is located on each bucket and the apparatus includes means for opening and closing the jaw in timed relation with the insertion of a leaflet between the open jaw and the lower surface of the article bucket. The jaw is constructed so that the leaflet is folded across the front of the article as it is closed and thereafter inserted into the carton with the article as the jaw reopens. The leaflets are inserted between the open jaw and the lower surface of the article bucket by means of a conveyor which transports the leaflets along a parallel path to the buckets. Additional mechanism is used to push the leaflets toward the article buckets as they are being advanced along this path with the buckets.

SUMMARY OF THE INVENTION

It is a principal object of the present invention to provide simplified means for conveying and transferring the leaflets to clamps which are being conveyed along a first path. These clamps may be attached to article buckets as shown in my previously described co-pending application.

The object of the invention is accomplished by providing a method and means for transporting leaflets to spaced clamps on a first conveyor from a second conveyor. The clamps are carried along a first path and the leaflets are carried along a second path which converges with the first path. The leaflets are deposited on the second conveyor in space relationship and in synchronism with the first conveyor so that one leaflet is deposited for each clamp and this leaflet arrives at the point of convergence with the first and second paths behind its respective clamp. The leaflet is then conveyed at a greater speed than the clamp along the first path so that it becomes aligned with its respective clamp. Each clamp is in the open position from the point of convergence of the first and second paths until it is aligned with its respective leaflet and closed thereafter to clamp the leaflet.

The invention will become more readily understood from the following detailed description taken in conjunction with the accompanying drawings.

DETAILED DESCRIPTION OF THE INVENTION

Figure 1:
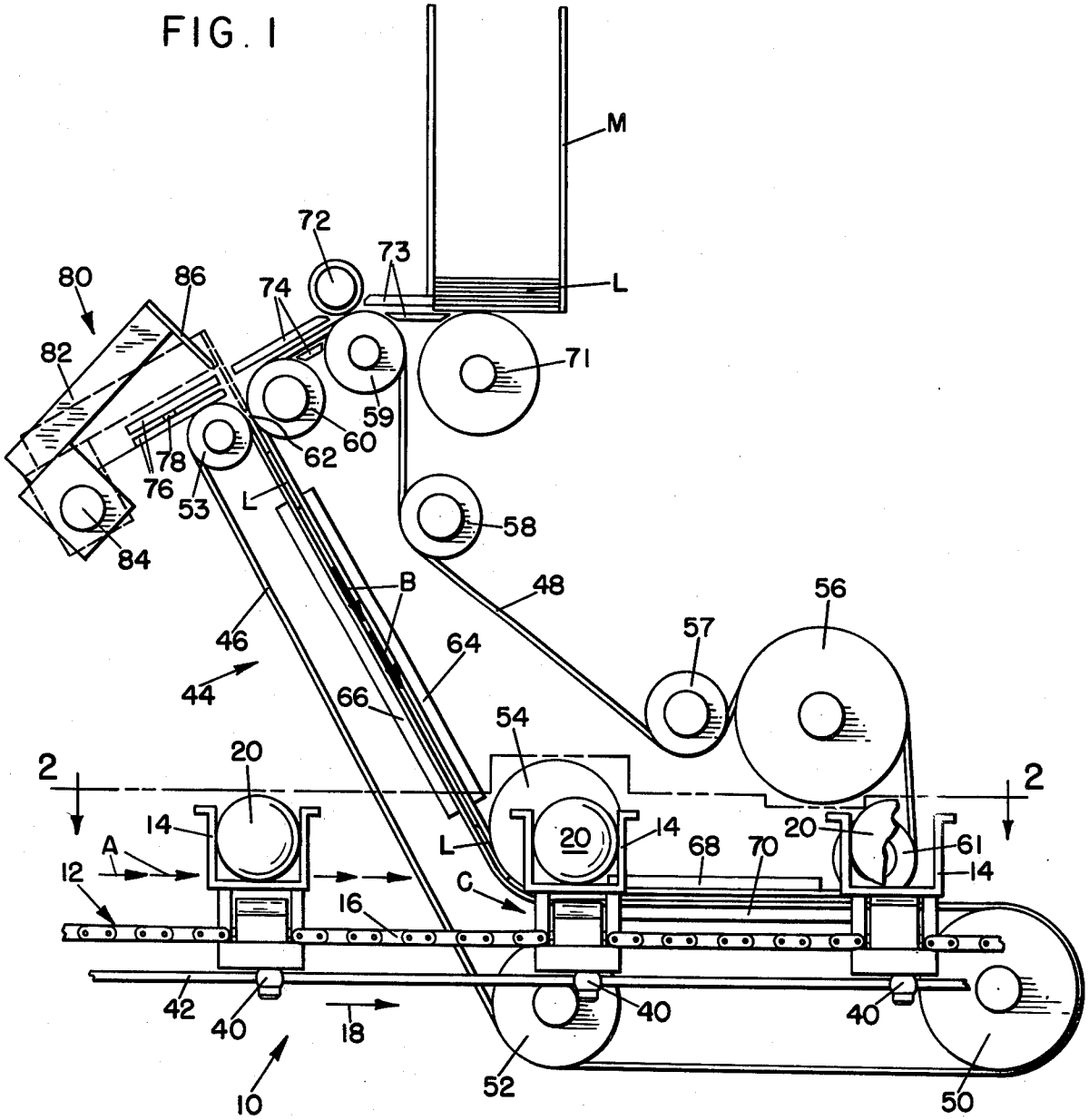
FIG. 1 is a side elevation of the invention in association with a fragmentary view of a packaging machine.

Referring particularly to FIGS. 1 through 4, the packaging machine to which the invention is applied is indicated generally by the reference numeral 10 and includes an article bucket conveyor 12 which constitutes a first conveyor. Conveyor 12 comprises a plurality of article buckets 14 mounted on a pair of endless chains 16, the top reaches of which are driven in the direction of arrow 18 by drive means, not shown. The articles to be packaged are indicated at 20 and deposited within the buckets from a point up-stream by means well known in the art, but which are not part of this invention.

Figure 2:
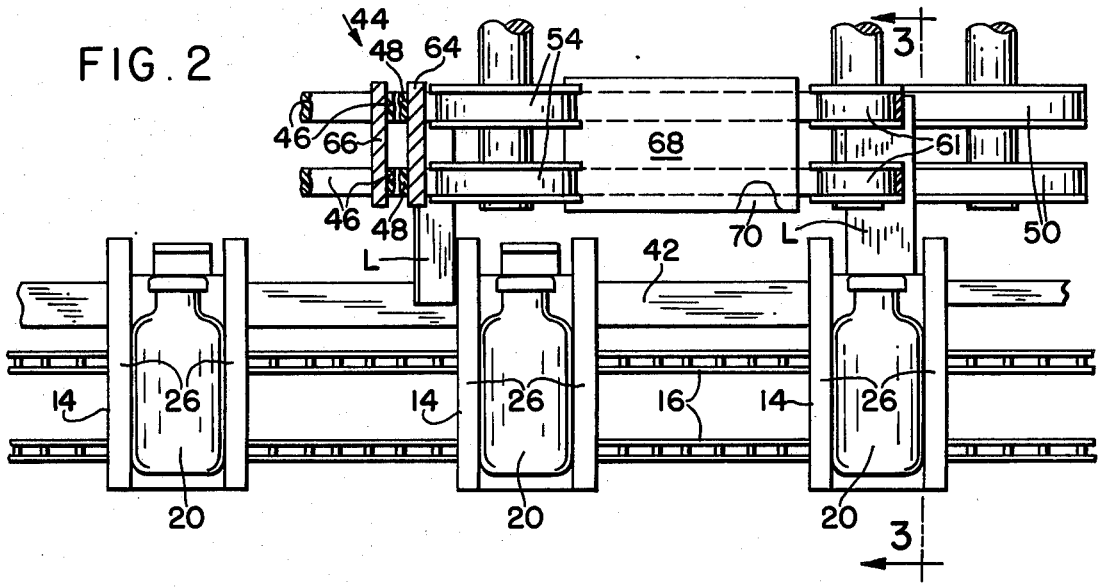
FIG. 2 is a horizontal section taken along line 2—2 of FIG. 1.
Figure 3:
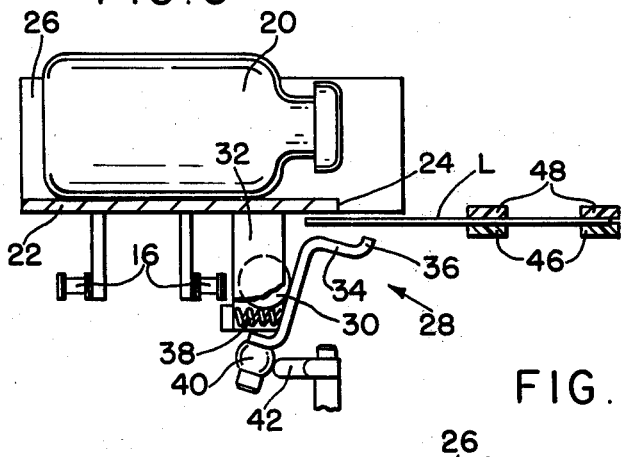
FIG. 3 is a vertical section taken along line 3—3 of FIG. 2, showing a leaflet positioned between an opened clamping jaw and the lower surface of its corresponding article bucket.
Figure 4:
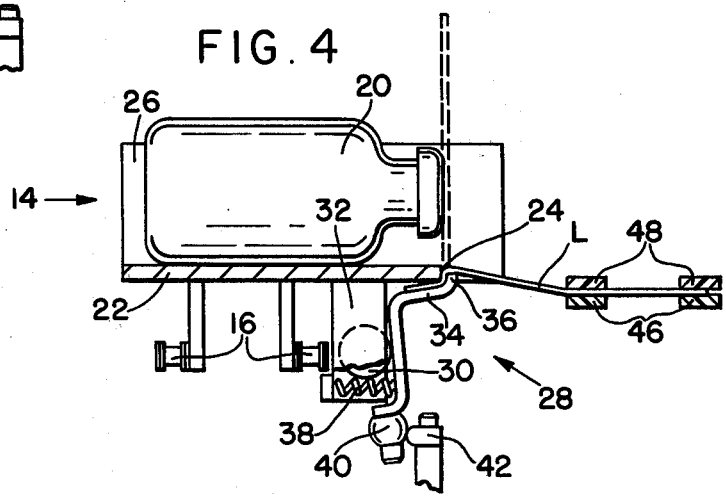
FIG. 4 is view similar to FIG. 3, showing a leaflet clamped between the closed jaw of a leaflet clamp and the lower surface of the corresponding article bucket.

Referring particularly to FIGS. 2, 3 and 4, one of the buckets 14 is shown in greater detail and includes a bottom plate 22 which has a front edge 24 and sides 26. A clamp generally indicated at 28 is pivotally mounted at 30 to a bracket 32 which extends downwardly from sides 26. Clamp 28 comprises a jaw 34 which includes a lip 36 and a compression spring 38 which normally maintains jaw 34 in the closed position with lip 36 against the front edge 24 of plate 22. A follower 40 is fixed to the lower end of clamp 34 for engagement with elongated cam 42. Cam 42 is positioned to open the jaw 34 at the proper time during the packaging sequence which is described in greater detail hereinbelow. The clamps 28 are conveyed along a first path indicated by arrows A as shown in FIG. 1.

A leaflet conveyor or second conveyor 44 comprises groups of endless belts 46 and 48. Although several runs of belts 46 and 48 are disclosed, a single run of each belt may be employed. Belts 46 are trained around a drive roll 50 and follow a path defined by idler rolls 52, 53 and 54. Conveyor belts 48 are trained around a drive roll 56 and follow a path defined by idler rolls 57, 58, 59, 60, previously described roll 54 and idler roll 61. Rolls 53 and 60 are adjacent and both groups of belts 46 and 48 pass between rolls 53 and 60 and form a nip 62 into which a leaflet may be fed. Belts 46 and 48 travel together from nip 62 and pass between a first pair of plates 64 and 66 down to roll 54 and between a second pair of plates 68 and 70 after which belts 48 and 46 diverge, belts 48 travelling upwardly from roll 61 and belts 46 travelling around roll 50. Belts 46 and 48 are effective to carry a leaflet which is inserted between nip 62 along a second path indicated by the arrows B. This path converges with first path A at a point C at the lower end of roll 54.

A stack of leaflets L is stored in a magazine M and the leaflets are fed from the magazine from the bottom thereof by a feed roll 71 which advances the bottom leaflet between a first pair of spaced guides 73, between the nip of previously described roll 59 and a roll 72 and then between a second pair of spaced guides 74, over roll 60 and between a third pair of spaced guides 76. A stop 78 is located between guides 76 to limit the movement of the leaflet. When the leaflet comes to rest between the guides 76, it extends across roll 60 above nip 62. A tucking mechanism generally indicated at 80 includes an arm 82 which is pivoted on a reciprocating shaft 84. A tucking blade 86 is mounted on the opposite end of arm 82 and occupies the full line position shown in FIG. 1 during movement of the leaflet into its position between guides 76. After the leaflet has arrived at this position, shaft 84 is reciprocated so that tucker blade 86 moves to the dotted line position shown in FIG. 1 and is effective to push the center of the leaflet into the nip 62 between rolls 53 and 60. Once this is accomplished, belts 46 and 48 pull the leaflet between rolls 53 and 60 and down along path B, thereby folding the leaflet. The leaflet inserting mechanism disclosed herein is only an example of several types of leaflet depositing mechanisms which can be used with the present invention. It may be desired to insert a leaflet without any folds or by providing mechanism which will fold the leaflet into several folds prior to being advanced along path B.

All the drives which have been described are synchronized so that leaflets are deposited into nip 62 at the same rate at which clamps or article buckets pass converging point C. Also, the timing is such that each leaflet arrives at point C just behind the clamp of a respective article bucket. Belts 46 and 48 are also driven at a greater linear speed than endless chains 16 so that a leaflet which arrives just behind the clamp of its respective article bucket at point C will overtake the article bucket and become aligned with the clamp by the time it reaches roll 61. All during this time, the clamp will be in the open position as shown in FIG. 3. As the leaflet overtakes the clamp, it will pass between the clamping jaw 34 and the bottom 22 of the article bucket. After the leaflet has been aligned with clamping jaw 34, jaw 34 will then be closed to clamp the leaflet against the bottom 22 of the article bucket as shown in FIG. 4. Cam 42 is designed to open jaw 34 at a point before C and to close jaw 34 at a point after the leaflet has become aligned between jaw 34 and the bottom plate 22 or the article bucket. After the leaflet has been clamped, belts 46 and 48 diverge. The leaflet will then be released from between these belts and forced up to the dotted line position shown in FIG. 4 by the lip 36 of the clamp.

GENERAL OPERATION

Having described the machine components of the invention, the steps of feeding a leaflet from magazine M, transferring it to the second conveyor and then transferring it to the clamp of the first conveyor will be traced in greater detail.

Figure 5:
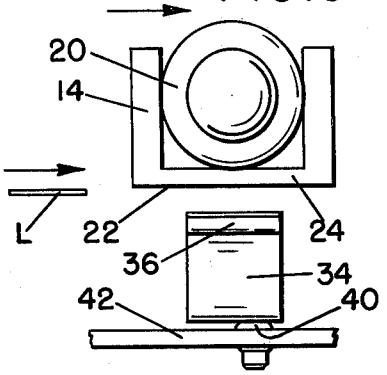
FIGS. 5 - 9 are diagramatic views illustrating the steps of transferring a leaflet clamp.
Figure 6:
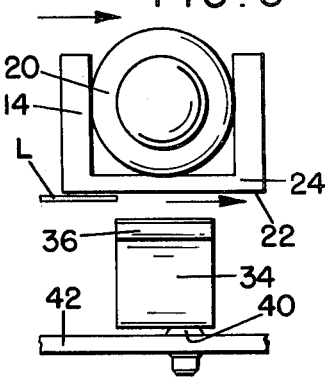
Figure 7:
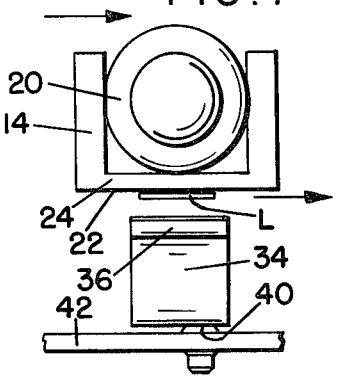
Figure 8:
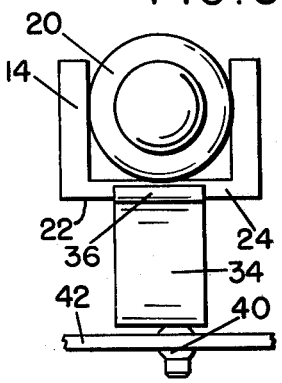
Figure 9:
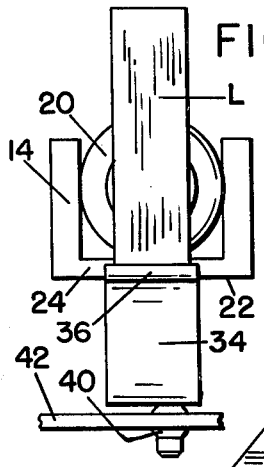
Figure 10:
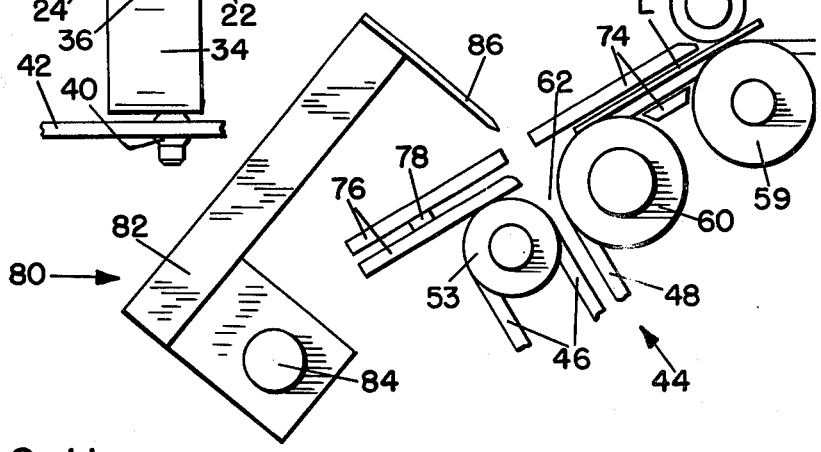
FIGS. 10 - 12 are diagramatic views illustrating the steps of depositing a leaflet on the first conveyor.
Figure 11:
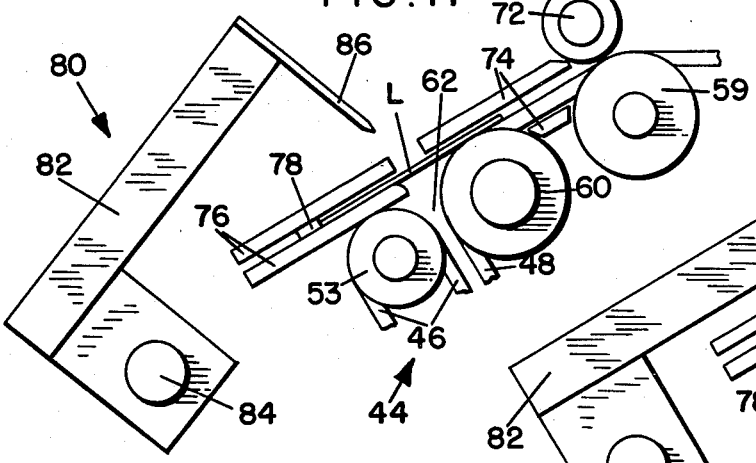
Figure 12:
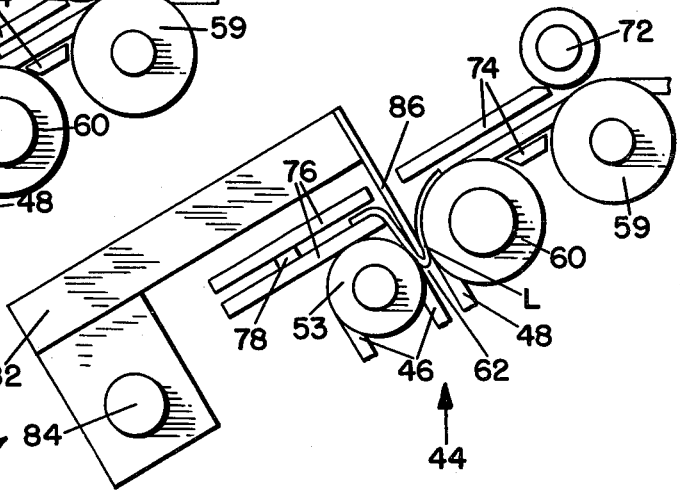

Referring particularly to FIGS. 1 and 10 through 12, a leaflet L is taken from the bottom of the stack in magazine M and fed between first guides 73, between rolls 72 and 59 and between second guides 74 as shown in FIG. 10. The leaflet is then advanced over roll 60 and between plates 76 until it reaches stop 78 as shown in FIG. 11. At this time, shaft 84 is reciprocated so that blade 86 moves from the full line position to the dotted line position as shown in FIG. 1 and pushes the center of the leaflet into nip 62 as shown in FIG. 12. The leaflet is then pulled between rolls 53 and 60 and transported by belts 46 and 48 down to point C. All of the drives are synchronized and timed so that the leaflet arrives at point C just behind the clamp of an article bucket as shown in FIG. 1. After point C, paths B and A converge. Since belts 46 and 48 travel at a greater lineal speed than chains 16, the leaflet begins to overtake the clamp on the article bucket as shown in FIG. 5. Before the article buckets reach point C, the clamps are opened by elongated cam 42 to the position shown in FIGS. 3 and 5. As the clamp and the leaflet move further along the converging section of paths A and B, the leaflet enters the space between clamp 34 and the lower or bottom plate 22 as shown in FIG. 6. Towards the end of the converging section of paths A and B the leaflet becomes fully aligned between the clamping jaw 34 and bottom plate 22 as shown in FIG. 7. At this point, elongated cam 42 acts on follower 40 to allow the clamp 34 to return to its closed position as shown in FIGS. 4 and 8, thereby clamping a portion of the leaflet against the front edge 24 and bottom of bottom plate 22. At that point, belts 46 and 48 diverge, leaving the leaflet clamped as shown in FIGS. 9 and in the dotted line position as shown in FIG. 4. The article bucket with its clamped leaflet is then conveyed to a further point of the packaging machinery where the article is transferred into a carton together with the leaflet in the manner disclosed in my previously described co-pending application.

I claim:

1. In a packaging machine, leaflet transferring means comprising:

a. a first conveyor which comprises spaced leaflet clamps having at least two clamping surfaces, said clamps having an open position for insertion of leaflets between said clamping surfaces and a closed position for clamping a leaflet which has been inserted between said clamping surfaces, said first conveyor being effective to convey said clamps along a first path;

b. a second conveyor for conveying leaflets along a second path which converges with said first path and which travels at a greater linear speed than said first conveyor, said second conveyor having a first portion which has a longitudinal axis disposed at an angle to said first path and a second portion which has a longitudinal axis disposed substantially parallel to said first path;

c. means for depositing leaflets on said second conveyor so that they are spaced from one another, said depositing means being synchronized with said first conveyor so that a leaflet is deposited on said second conveyor for each of said clamps which passes the point of convergence of said first and second conveyors and so that each of said deposited leaflets arrives at said point of convergence at a point behind its respective clamp;

d. means for opening each of said clamps at a point on said first path prior to the point where said clamp is aligned with its respective leaflet to enable said leaflet to be positioned between the clamping surfaces of said clamp; and e. means for closing each of said clamps at a point where its respective leaflet is positioned between the jaws of said clamp to enable said leaflet to be clamped.

2. The leaflet transferring means set forth in claim 1, wherein said second conveyor comprises:

a. a first conveyor belt; and b. a second conveyor belt which is in contact with said first conveyor belt for carrying leaflets therebetween, said second conveyor belt, forming with said first conveyor belt, a nip into which leaflets are inserted by said depositing means.

3. In a packaging machine, leaflet transferring means comprising:

a. a first conveyor which comprises spaced leaflet clamps having at least two clamping surfaces, said clamps having an open position for insertion of leaflets between said clamping surfaces and a closed position for clamping a leaflet which has been inserted between said clamping surfaces, said first conveyor being effective to convey said clamps along a first path;

b. a second conveyor for conveying leaflets along a second path which converges with said first path and which travels at a greater linear speed than said first conveyor, said second conveyor including i. a first portion located above said first conveyor and having a longitudinal axis disposed at an angle to the longitudinal axis of said first conveyor, for transporting said leaflets from a point above said first path down to said first path, and ii. a second portion located substantially in the same plane as said leaflet clamps and having a longitudinal axis which is parallel to the longitudinal axis of said first conveyor, for transporting said leaflets between said clamping surfaces;

c. means for depositing leaflets on said second conveyor so that they are spaced from one another, said depositing means being synchronized with said first conveyor so that a leaflet is deposited on said second conveyor for each of said clamps which passes the point of convergence of said first and second conveyors and so that each of said deposited leaflets arrives at said point of convergence at a point behind its respective clamp;

d. means for opening each of said clamps at a point on said first path prior to the point where said clamp is aligned with its respective leaflet to enable said leaflet to be positioned between the clamping surfaces of said clamp; and e. means for closing each of said clamps at a point where its respective leaflet is positioned between the jaws of said clamp to enable said leaflet to be clamped.

4. In a packaging machine, leaflet transferring means comprising:

a. a first conveyor which comprises spaced leaflet clamps having at least two clamping surfaces, said clamps having an open position for insertion of leaflets between said clamping surfaces and a closed position for clamping a leaflet which has been inserted between said clamping surfaces, said first conveyor being effective to convey said clamps along a first path;

b. a second conveyor for conveying leaflets along a second path which converges with said first path and which travels at a greater linear speed than said first conveyor;

c. means for depositing leaflets on said second conveyor so that they are spaced from one another, said depositing means being synchronized with said first conveyor so that a leaflet is deposited on said second conveyor for each of said clamps which passes the point of convergence of said first and second conveyors and so that each of said deposited leaflets arrives at said point of convergence at a point behind its respective clamp;

d. means for opening each of said clamps at a point on said first path prior to the point where said clamp is aligned with its respective leaflet to enable said leaflet to be positioned between the clamping surfaces of said clamp; and e. means for closing each of said clamps at a point where its respective leaflet is positioned between the jaws of said clamp to enable said leaflet to be clamped; said first and second conveyors being parallel and spaced so that said first and second paths extend along the same longitudinal axis and coincide from said point of convergence up to at least the point where said leaflets are clamped by said leaflet clamps.

5. The method of transferring leaflets to leaflet clamps having at least two clamping surfaces, said clamps having an open position for insertion of leaflets between said clamping surfaces and a closed position for clamping a leaflet which has been inserted between said clamping surfaces, said method comprising the following steps:

a. conveying said leaflet clamps in spaced relationship along a first path;

b. conveying spaced leaflets along a second path which converges with said first path, said second path having a first portion which intersects said first path and a second portion which is substantially coincident with said first path, so that said leaflets arrive at the point of convergence of said first and second paths in an interlaced relationship with said leaflet clamps;

c. opening each of said clamps before said point of convergence;

d. advancing said leaflets at a greater linear speed than said leaflet clamps so that each leaflet becomes aligned between the clamping surfaces of its respective leaflet clamp; and e. closing each of said clamps after its respective leaflet has become aligned between the clamping surfaces thereof.

6. The method of transferring leaflets to leaflet clamps as set forth in claim 5, wherein said first path is horizontal and:

a. said first portion of said second path is located above and at an angle to said first path.

* * * * *